United States Patent [19]

Schade, Jr.

[11] 4,300,091

[45] Nov. 10, 1981

[54] CURRENT REGULATING CIRCUITRY

[75] Inventor: Otto H. Schade, Jr., N. Caldwell, N.J.

[73] Assignee: RCA Corporation, New York, N.Y.

[21] Appl. No.: 167,696

[22] Filed: Jul. 11, 1980

[51] Int. Cl.[3] ..... G05F 3/16

[52] U.S. Cl. ..... 323/315; 323/316; 307/297; 307/304; 330/288

[58] Field of Search ..... 323/312, 314, 315, 316, 323/907; 307/296 R, 297, 304, 279; 330/252, 253, 257, 277, 288, 296; 357/41, 43

[56] References Cited

U.S. PATENT DOCUMENTS

| | | | |
|---|---|---|---|
| 3,320,439 | 5/1967 | Widlar | 307/297 |
| 3,629,691 | 12/1971 | Wheatley, Jr. | 323/315 |
| 3,629,691 | 12/1971 | Goyer | 323/315 |
| 3,887,863 | 6/1975 | Brokaw | 323/314 |
| 3,911,353 | 10/1975 | van de Plassche | 323/315 |
| 4,004,164 | 1/1977 | Cranford, Jr. et al. | 307/297 |
| 4,009,432 | 2/1977 | Dingwall et al. | 307/296 R |
| 4,031,456 | 6/1977 | Shimada et al. | 323/315 |
| 4,063,149 | 12/1977 | Crowle | 323/316 |
| 4,068,134 | 1/1978 | Tobey, Jr. et al. | 307/304 X |
| 4,096,430 | 6/1978 | Waldron | 307/297 |
| 4,100,437 | 7/1978 | Hoff, Jr. | 307/297 |
| 4,188,588 | 2/1980 | Dingwall | 330/253 |

FOREIGN PATENT DOCUMENTS

| | | |
|---|---|---|
| 2140692 | 5/1972 | Fed. Rep. of Germany . |
| 628228 | of 0000 | Japan . |
| 1373133 | 11/1974 | United Kingdom . |

OTHER PUBLICATIONS

Vittoz and Neyroud, "A Low-Voltage CMOS Bandgap Reference", IEEE Journal of Solid-State Circuits, vol. SC-14, No. 3, Jun. 1979, pp. 573-577.

van de Plassche and van Kessel, "Integrated Linear Basic Circuits", Phillips Technical Review, vol. 32, No. 1, p. 7 (1971).

*Primary Examiner*—William M. Shoop
*Assistant Examiner*—Peter S. Wong
*Attorney, Agent, or Firm*—Eugene M. Whitacre; Paul J. Rasmussen; Allen LeRoy Limberg

[57] ABSTRACT

The difference between the source-to-gate voltages of two MOSFET's with different dopings of the regions in which their respective conduction channels are induced is applied to a resistor to determine the level to which current is regulated in current regulating circuitry embodying the invention.

30 Claims, 14 Drawing Figures

CURRENT REGULATING CIRCUITRY

The present invention relates to current regulating circuitry.

Current regulating circuitry of the following type is commonly fabricated in monolithically integrated form. The circuitry uses two transistors, each having respective input, output and common electrodes, and exhibiting current flow between its output and common electrodes which is exponentially related to the voltage between its common and input electrodes. The common electrode of the second of these transistors is connected via a common-electrode degeneration resistance to the common electrode of the first transistor, which is connected in turn to a point of reference potential. A voltage generated in response to differential combining of currents flowing through the output electrodes of these transistors is applied to an interconnection between the input electrodes of the first and second transistors to complete a degenerative output-to-input-electrode feedback connection for the first transistor and to complete a regenerative output-to-input-electrode feedback connection for the second transistor. At lower levels of the currents flowing through the output electrodes of the first and second transistors, the regenerative feedback loop including the second transistor has greater gain than the degenerative feedback loop including the first transistor, so these currents tend to grow until the potential drop across the common-electrode degeneration resistance reduces the common-electrode-to-input-electrode voltage of the second transistor respective to that of the first transistor to a sufficient extent that the gain in the regenerative feedback loop including the second transistor is reduced to substantially equal the gain in the degenerative feedback loop including the first transistor. When this equilibrium condition is reached, there is no further growth in the currents flowing through the first and second transistor output electrodes.

In certain prior art circuits of this type the transistors have been bipolar transistors concurrently fabricated by the same epitaxial growth, diffusion and oxidation steps. In other prior art circuits of this type the transistors have been metal-oxide-semiconductor (MOS) field effect transistors concurrently fabricated by the same epitaxial growth, diffusion and oxidation steps, which transistors are operated in the subthreshold region where channel current change is exponentially related to change in source-to-gate potential. To obtain differences between the emitter-to-base potentials of the first and second transistors in the first-mentioned class of these circuits—or their source-to-gate potentials in the second-mentioned class of these circuits—which differences are of relatively small percentage, these circuits have to be dimensioned to operate the transistors so their internal electric fields have widely different current density values. This requires that the second transistor be made substantially larger than the first (in effect being a large numbered plurality of paralleled transistors each like the first), that the second transistor conduct substantially smaller current than the first, or that a combination of these factors be used. In the field effect transistor circuitry a further control may be exercised, not only scaling the first and second transistors as to width of conduction channel, but as to length as well or instead. Scaling the physical dimensions of the first and second transistors undesirably tends to increase the area they take up on the surface of the monolithic integrated circuit. Scaling the currents conducted by the transistors, as they depart from 1:1 ratio, also involves an increase in the area the current regulating circuitry takes up on the die. This is because there must be a deparature from 1:1 ratio in the physical dimensioning of elements involved in differentially combining currents from the first and second transistors to generate feedback voltage for application to the electrodes controlling their conduction.

The threshold voltage of $V_T$ of a field effect transistor (FET) is that value of its source-to-gate voltage at which the tendency of its channel current to be in exponential relationship with its source-to-gate voltage (or $V_{GS}$), where $V_{GS}$ is cut back to result in the channel being in weak inversion condition and exhibiting relatively low conductivity, to yield to the tendency of its channel current to be in square-law relationship with its $V_{GS}$, where $V_{GS}$ is advanced to result in the channel being in strong inversion condition and exhibiting relatively high conductivity. Recent advances in the art of ion implantation into crystalline solids has facilitated the monolithic integration of FET's with different degrees of doping in the regions of semiconductive material in which their conduction channels are electrostatically induced responsive to their gate electrode potentials. FET's which are similar in their physical dimensions but have different doping in the regions in which their conduction channels are induced will exhibit characteristic curves that are similar, except for a displacement $\Delta V_T$ from each other along the $V_{GS}$ axis, in cross-plots of their channel current versus $V_{GS}$. This $\Delta V_T$ displacement will be noted not only at the value of channel current associated with their respective $V_T$'s, but at the other values of their channel currents. Interestingly, $\Delta V_T$ is substantially independent of temperature if the transistors whose characteristics are being compared are operated at the same temperature.

FET's which require source-to-gate voltage of the same polarity at their drain-to-source current in order to conduct that current are normally termed "enhancement-mode" type, while those that will conduct despite their source-to-gate voltage being opposite in polarity to their drain-to-source current are normally termed "depletion-mode" type. Depending on the channel doping, a gamut of FET conduction characteristics is available, ranging continuously from pronounced depletion-mode types to slightly enhancement-mode type to increasingly pronounced enhancement-mode types. In this specification the terms "relatively depletion-mode" and "relatively enhancement-mode" will be used to describe the FET's with differing threshold voltages disposed toward the pronounced depletion-mode and the pronounced enhancement-mode ends of this range, irrespective of whether the transistors are both depletion-mode types or both enhancement-mode types or whether one of them is depletion-mode type and the other enhancement-mode type.

Current regulating circuits of the general type described above, but which incorporate first and second transistors which are relatively enhancement-mode and relatively depletion-mode field effect transistors, respectively, embody the present invention. The substantial difference between the $V_{GS}$'s of the first and second transistors, required to define the potential drop across the source degradation resistance of the second transistor, is readily achieved without having to operate the first and second transistors so their internal fields have widely differing current densities. This reduces the need for scaling the physical dimensions of circuit elements in ratios that consume excessive area on the monolithic integrated circuit. Furthermore, $\Delta V_T$ can be readily changed from one integrated-circuit wafer to another without need for mask changes, the ion implantation offering an independent process control upon the value of regulator current for the current regulators in the integrated circuits on that wafer, which process control need not affect any other portion of the circuitry in appreciable degree.

Figure 1:
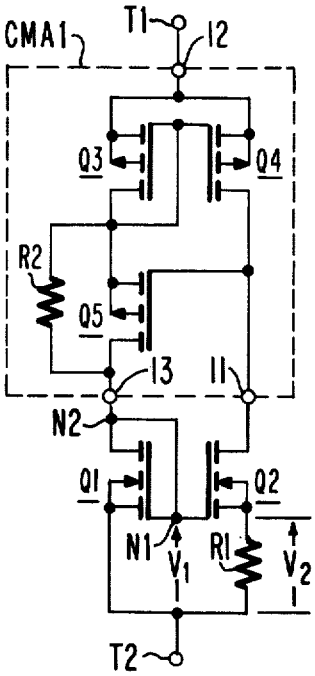
FIGS. 1, 2, 3, 13 and 14 are schematic diagrams of alternate embodiments of the present invention, each of which is a two-terminal current regulator.
Figure 2:
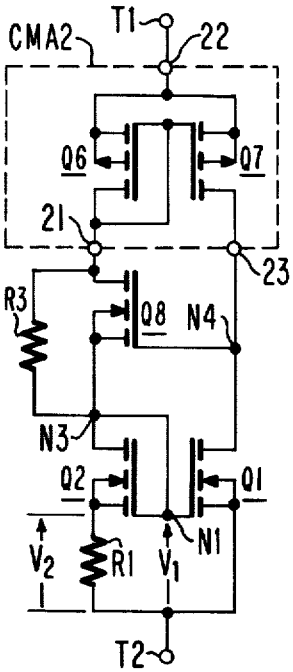
Figure 3:
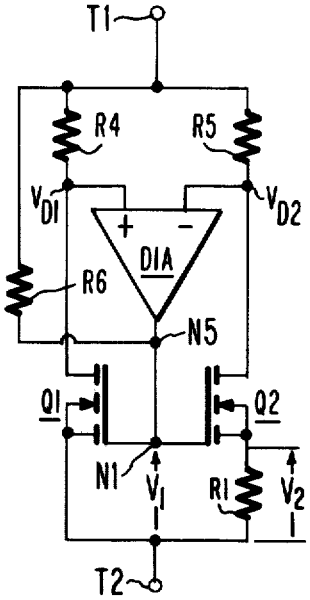

Each of the two-terminal current regulators of FIGS. 1, 2 and 3 regulates the flow of current between its terminals T1 and T2 so long as sufficient potential exists between T1 and T2 to operate the transistors in the regulator. N-channel FET's Q1 and Q2 are enhancement-mode and depletion-mode, respectively, with an interconnection at node N1 between their gates. The source of Q1 is directly connected to terminal T2, and the source of Q2 is connected to terminal T2 via resistive element R1.

As the potential $V_1$ between terminal T2 and node N1 is increased in positive sense, the lower threshold voltage of Q2 as compared to Q1 causes the drain current $I_{D2}$ of Q2 at first to tend to exceed the drain current $I_{D1}$ of Q1. As $V_1$ increases still further, the increasing source current of Q2 flowing through R1 decreases the source-to-gate voltage $V_{GS2}$ of Q2 respective to the source-to-gate voltage $V_{GS1}$ of Q1, which continues to equal $V_1$. So the tendency of Q2 to conduct more heavily than Q1 is overcome by current degeneration in the source connection of Q2 to terminal T2.

The voltage $V_1$ is developed in response to the difference between the drain currents $I_{D2}$ and $I_{D1}$ of Q2 and Q1, respectively, in each of the FIG. 1, FIG. 2 and FIG. 3 circuits. But the means used for developing $V_1$ differ from each other in these circuits, and still different means for developing $V_1$ may be used in other embodiments of the present invention not specifically shown.

In FIG. 1 the drain current $I_{D2}$ of Q2 is applied to the input connection 11 of a current mirror amplifier CMA 1, the common connection 12 of which connects to terminal T1. The output connection 13 of CMA 1 supplies a current of the same amplitude as $I_{D2}$, but of opposite polarity to node N2 to which Q1 supplies its drain current $I_{D1}$. The sum of these oppositely directed currents, $I_{D2}-I_{D1}$, charges the nodal capacitance at node N2 to develop a voltage applied to node N1 by direct-coupling means. This direct-coupling means most simply consists of direct connection of nodes N2 and N1, as specifically shown in FIG. 1. This connection completes a degenerative drain-to-gate feedback connection for Q1 and a regenerative drain-to-gate feedback connection for Q2.

At levels of V1 below equilibrium value, the conduction of Q2 exceeds that of Q1 since: (a) $V_{GS2}$ and $V_{GS}$ are nearly equal; and (b) Q2 is a depletion-mode FET while Q1 is enhancement mode and thus more highly conductive for the same $V_{GS}$. At these lower levels of $V_1$, conduction of Q2 is insufficient that the potential drop $V_2$ across R1 reduces $V_{GS2}$ sufficiently respective to $V_{GS1}$ to counteract this tendency of Q2 to be more conductive than Q1. So, the current $I_{D2}-I_{D1}$ supplied to node N2 charges the capacitance at that node to increase the voltage $V_1$ applied to node N1. One may describe this condition as one in which the regenerative feedback loop, including Q2 in common-source amplifier connection and CMA 1, has higher loop gain than the degenerative feedback loop, including Q1 in common-source amplifier connection with direct-coupled drain-to-gate feedback.

As $V_1$ approaches equilibrium value, the potential drop $V_2$ across R1 reduces $V_{GS2}$ respective to $V_{GS1}$ sufficiently that $I_{D2}$ does not exceed $I_{D1}$. So, the current $I_{D2}-I_{D1}$ supplied to node N2 is essentially zero-valued; and the charge on the nodal capacitance at node N1 is maintained constant, responsive to which $V_1$ remains constant. The degenerative and regenerative feedback loops have equal gains for this condition. Tendency for $V_1$ to increase past equilibrium value causes $I_{D1}$ to exceed $I_{D2}$, so the current $I_{D2}-I_{D1}$ supplied to node N2 is of a sense to discharge the nodal capacitance and reduce $V_1$. Tendency for $V_1$ to decrease below equilibrium value is corrected in the same way $V_1$ is originally brought to equilibrium value.

Supposing Q1 and Q2 to have channels with similar width to length (W/L) ratios, the equilibrium value of $V_1$ will be reached when the potential drop $V_2$ across R1 equals the displacement $\Delta V_T$ along the $V_{GS}$ axis of their characteristic curves in a channel current versus $V_{GS}$ cross-plot. The value of Q2 source current for this condition is determined by Ohm's Law and determines the value of $V_{GS2}$ which adds to $V_2=\Delta V_T$ to determine $V_1$ equilibrium value. Actually, the equilibrium value of $V_1$ is an academic concern, except insofar as determining the minimum value of voltage that must be maintained between terminals T2 and T1 to assure proper biasing of the regulator transistors. Of greater concern is the value of $V_2$, which divided by the resistance $R_1$ of R1, determines the equilibrium value of the source current of Q2. $V_2/R$, multiplied by $(1+G)/G$, the current gain of CMA 1 as between its input connection 11 and common connection 12, is the value of current that will flow between terminals T1 and T2 of the two terminal current regulators. In the FIG. 1 current regulator as thus far described, where Q1 and Q2 have equal W/L ratios and where CMA 1 has respective current gains of $-1$ and 2 as from its input connection 11 to its output and common connections 12 and 13, this current will have a value of $2V_2/R_1$.

If CMA 1 were replaced by the simplest current mirror amplifier—i.e., similar to CMA 2 of FIG. 2 with input connection 21, common connection 22, and output connection 23—designing Q1 and Q2 to have similar channel dimensions would clearly be an optimum design. CMA 1 is used instead of this simpler current mirror amplifier to provide a simple means for assuring that, when voltage is first applied between terminals T2 and T1, the regenerative feedback loop connection including Q2 in common-source-amplifier connection receives an initial current to charge node N2 capacitance sufficiently to apply an initial value of $V_1$ to the gate of Q2 that gets conduction through its channel started to that $V_1$ can be regeneratively increased towards its equilibrium value. The path for this initial current is from terminal T1 through diode-connected p-channel FET Q3 and resistor R2 to node N2. Diode-connected Q3 is connected between the source and gate of another p-channel FET Q4 to form a simple current mirror amplifier, a component of CMA 1, which provides degenerative source-to-gate current feedback to p-channel FET Q5. Q5 is in common-source-amplifier configuration with gate and drain connected to the input connection 11 and output connection 13 of CMA 1, respectively. Its source-to-gate feedback degenerates the current gain of Q5 to the reciprocal of the current gain of the component current mirror amplifier formed by Q3 and Q4. If R2 has a sufficiently low conductance compared to that of the channel of Q5, the shunt regulation afforded by source-generated Q5 subsumes the conductance of R2, so it does not affect the current gain of CMA 1 or appreciably lower its output impedance at normal operating current levels.

But since the use of CMA 1 places three FET channels (those of Q3, Q5, Q1) in series in the left-hand current path of the FIG. 1 current regulator and places only two FET channels (those of Q4, Q2) in its right-hand current path, it tends to be move economical of monolithic die area to make Q4 and Q2 somewhat larger than Q3, Q5 and Q1 where the minimum size of the FET's is determined by consideration of the size of the currents the FET's must conduct to provide for a given value of regulated current flow between terminals T1 and T2. It can be shown that making Q4 and Q2 channels wider than those of Q3, Q5 and Q1 by a factor approaching two can be advantageous in this regard, where channel length cannot be shortened. If channel length can be shortened it is advantageous to make the W/L ratio of Q4 and Q2 about 1.4 times that of Q3, Q5 and Q1. $V_2$ will still equal $\Delta V_T$, however, so long as the current gain of CMA 1 as between its input connection 11 and output connection 13 has an amplitude equal to the W/L ratio of Q1 divided by the W/L ratio of Q2.

When voltage is first applied between terminals T2 and T1 of the FIG. 2 current regulator, a relatively small initial current flows from terminal T2 to node N3 via a path through diode-connected p-channel FET Q6 and resistor R3 to charge capacitance at node N3 developing voltage to be applied to node N1 to establish $V_1$. Initially, conduction is greater in depletion-mode FET Q2 than in Q1, with the current to supply conduction through Q2 flowing through R3 or the channel of Q8 from the input connection 21 of CMA 2. The current flowing from common connection 22 of CMA 2 to its input connection 21 through diode-connected FET Q6 therein develops a voltage thereacross which is applied between source and gate of a further p-channel FET Q7 to condition it to supply a proportionally related drain current via CMA 2 output connection 23. This current tends to charge the capacitance at node N4 to increase the gate voltage of Q8 and draw it into increased conduction to supply continuously increasing source current to increase conduction through its source load, the series connection of the diode-connected FET Q2 and the resistor R1. Responsive to this $V_1$ tends to increase. These tendencies towards increase of the source current of Q8 and increase of $V_1$ are curbed as Q1 is biased into increasing conduction, the increasing demand for drain current presented by Q1 being satisfied by diversion of the drain current $I_{D7}$ of Q7 to itself in increasing apportionment rather than allowing $I_{D7}$ to further charge the capacitance at node N4 to increasing potential. If the amplitude of the current gain of CMA 2 as between its input connection 21 and output connection 23 is made equal to the W/L ratio of Q1 divided by the W/L ratio of Q2, $V_1$ will reach its equilibrium value when the potential drop $V_2$ across R1 equals $\Delta V_T$. Current flow between T1 and T2 will be regulated to $(H+1)\Delta V_T/R_1$, where $(H+1)$ is the current gain of CMA 2 as between its input connection 21 and common connection 22, which gain equals the W/L ratio of Q7 divided by that of Q6. In this configuration it can be advantageous to make the channel dimensions of Q6, Q8 and Q2 somewhat larger than those of Q7 and Q1 for reasons analogous to those for making the channel dimensions Q3, Q5 and Q1 larger than those of Q4 and Q2 in the FIG. 1 circuit.

The FIG. 3 current regulator is one in which it is often preferred to make the channel dimensions of Q1 and Q2 alike and to make the resistances $R_4$ and $R_5$ of resistors R4 and R5 alike. When voltage is first applied between terminals T2 and T1 initial current flow is from terminal T2 to node N5 via resistor R6, charging the capacitance at that node to develop a voltage to be applied to node N1 to establish V1. The drain currents $I_{D1}$ and $I_{D2}$ of Q1 and Q2 are converted to voltages $V_{D1}$ and $V_{D2}$, respectively, by applying them to the first ends of resistors R4 and R5, respectively, the second ends of which resistors are interconnected and referred to terminal T1. $V_{D1}$ and $V_{D2}$ are applied to the non-inverting and inverting input connections, respectively, of a differential input amplifier DIA having its output connection to node N5. At values of $V_1$ below equilibrium value, Q2 conducts more heavily than Q1, and $I_{D2}$ exceeds $I_{D1}$. So, $V_{D2}$ at the inverting connection of differential input amplifier DIA is negative respective of $V_{D1}$ at its non-inverting connection, causing the voltage at its output connection to node N5 to increase. $V_1$ increases to increase conduction of Q1 and Q2 until the source degeneration afforded Q2 by R1 decreases $I_{D2}$ to equal $I_{D1}$. Then $V_{D2}$ no longer is negative respective to $V_{D1}$ and differential-input amplifier DIA no longer supplies charging current from its output connection to node N5. This occurs when $V_2$ equals $\Delta V_T$.

Figure 4:
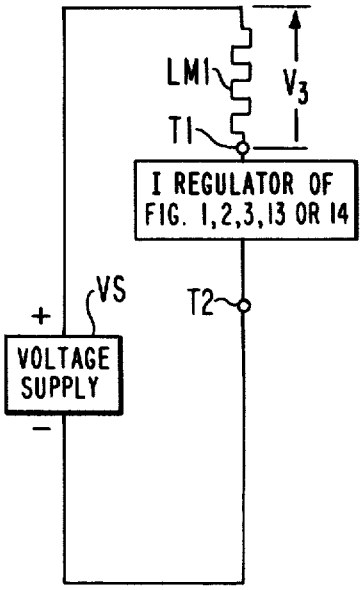
FIGS. 4, 5 and 6 are block schematic diagrams of how any one of these two-terminal current regulators may be connected in circuit.
Figure 5:
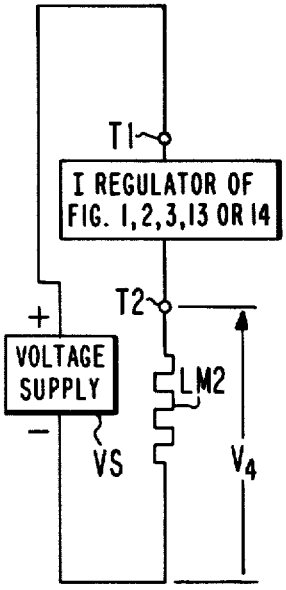
Figure 6:
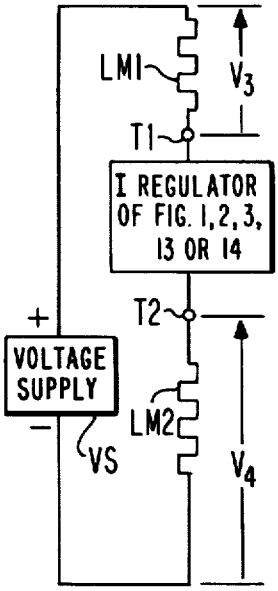

Any one of the two-terminal current regulators of FIGS. 1, 2 and 3 can be connected in circuit with a voltage supply VS and load means LM 1 as shown in FIG. 4, with a voltage supply VS and load means LM 2 as shown in FIG. 5, or with a voltage supply VS and two load means LM 1 and LM 2 as shown in FIG. 6. While load means LM 1 and LM 2 can take a variety of forms, they should have direct current paths through them so appropriate operating voltages are supplied to terminals T1 and T2 from voltage supply VS. Of especial interest is the case where LM 1 and LM 2 are resistive loads having resistances proportional to R1, since, if $V_2$ equals 66 $V_T$ and is temperature-independent, the potential drops $V_3$ and $V_4$ across LM 1 and LM 2 (which drops are proportional to $V_2$) are also temperature-independent and can be used as reference voltages. $V_2$ can be used to augment $V_4$, if desired. And, where one desires references voltages ($V_2$, $V_4$, $V_2+V_4$, or $V_2$ itself) that are not exactly zero-temperature-coefficient, but rather are positive-temperature-coefficient or negative-temperature-coefficient, this can be achieved by making Q1 and Q2 to have W/L ratios in different proportion than the proportions in which the responses to their respective drain currents are differentially combined to establish $V_1$.

Figure 7:
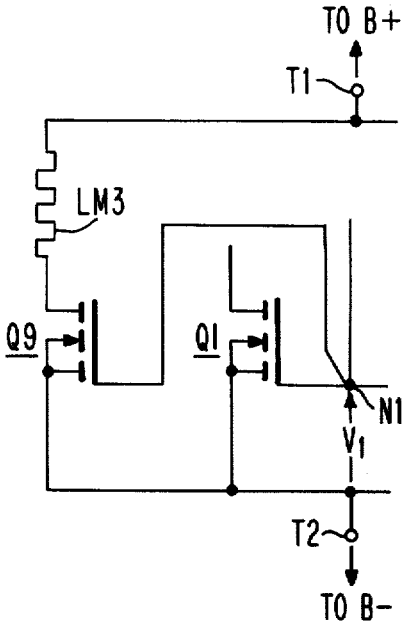
FIGS. 7 and 8 are schematic diagrams of modifications that can be made to the FIG. 1, 2, 3, 13 and 14 two-terminal current regulators to obtain current sources that are further embodiments of the present invention.
Figure 8:
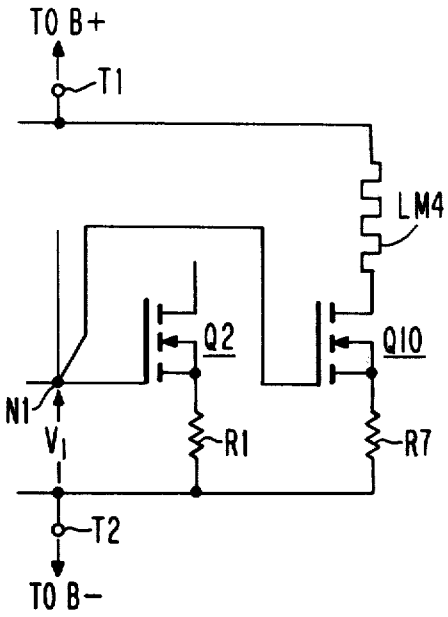
Figure 9:
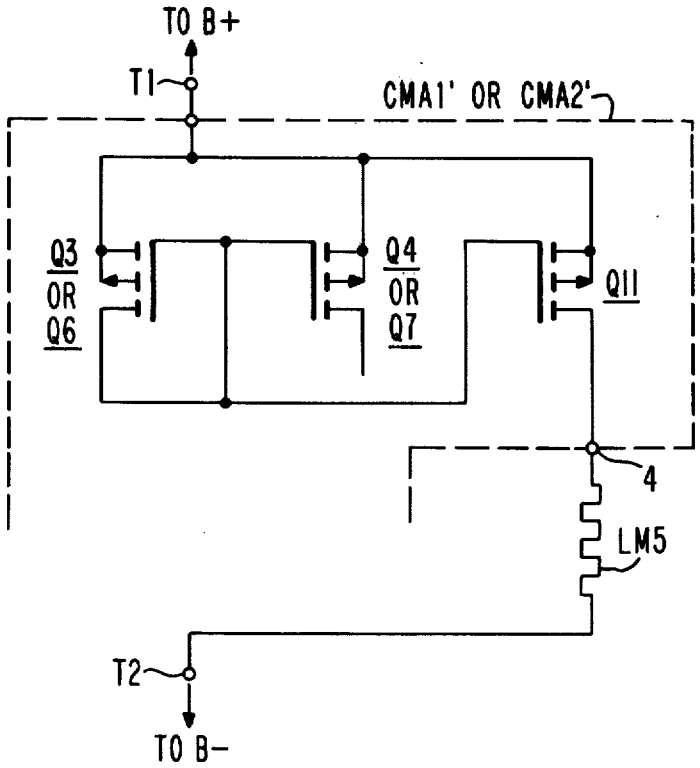
FIG. 9 is a schematic diagram of a modification that can be made to the FIG. 1, 2, 13 or 14 two-terminal current regulator to obtain a current source that also embodies the present invention.

One may also connect terminals T1 and T2 of any of the two-terminal current regulators of FIGS. 1, 2 and 3, directly to relatively positive and relatively negative direct operating voltages B+ and B−, and use the two-terminal current regulator simply as a bias network for establishing the level of current conducted by one or more other transistors. FIG. 7 shows an enhancement-mode n-channel transistor Q9 with $V_1$ applied as its source-to-gate voltage for conditioning it to demand a predetermined drain current from load means LM 3; preferably the W/L ratio of Q9 is the same as that of Q1. FIG. 8 shows $V_1$ applied across the gate-source circuit of a depletion-mode n-channel transistor Q10 and its source degeneration resistor R7 for conditioning it to demand a predetermined drain current from load means LM 4; preferably the W/L ratio of Q10 equals that of Q2 and the conductances of R7 and R1 are in the same ratio as the channel widths of Q10 and Q2. FIG. 9 shows a modification CMA 1' or CMA 2' that can be made in CMA 1 or CMA 2, respectively, where p-channel FET Q11 is connected to provide the current mirror amplifier a further output terminal 4 for supplying a predetermined level of current to load means LM 5.

Figure 10:
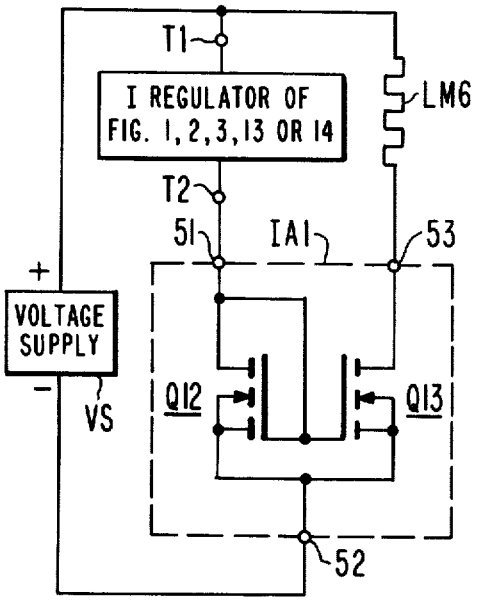
FIGS. 10 and 11 are schematic diagrams, partially in block form, showing how any of the two-terminal current regulators of FIGS. 1, 2, 3, 13 and 14 can be connected to supply current scaled upward or downward in value in accordance with further aspects of the present invention.

FIG. 10 shows how the output current from the current regulator of FIG. 1, 2 or 3 (or any other current) can be scaled upward in value using a current amplifier IA1 comprising a diode-connected relatively enhancement-mode n-channel FET Q12, provided with drain-to-gate feedback for use as a current-to-voltage converter, and a relatively depletion-mode-n-channel FET Q13, used as an ensuing voltage-to-current converter. The current regulator is connected between the positive pole of voltage supply VS and the input connection 51 of current amplifier IA1, and the common connection 52 of IA1 is returned to the negative pole of VS. The drain-to-gate feedback connection of Q12 adjusts its source-to-gate voltage $V_{GS12}$ to condition its channel between its drain and source electrodes to conduct the input current applied between connections 51 and 52 of current amplifier IA1. $V_{GS12}$ is applied as the source-to-gate voltage $V_{GS13}$ to Q13 to be converted into a drain current demand presented at output connection 53 of current amplifier IA1. This output connection connects to one end of load means LM 6, connected at its other end to the positive pole of voltage supply VS; so this current demand is satisfied by current flow through load means LM 6. This current demand is larger than the input current supplied to connection 51, presuming Q12 and Q13 to have channels of similar areas induced under their respective gate electrodes, owing to their being relatively enhancement-mode and relatively depletion-mode. Current amplifiers of the form IA1 takes are interesting in that Q12 can be scaled with a W/L ratio larger than that of Q13, with channel width sufficiently large that Q12 is operated in its subthreshold region where channel inversion is weak, while Q13 is operated in the square-law region where channel inversion is strong. While this form of IA1 does not exhibit high current gain, the percentage change in its output current demand at connection 53 is considerably smaller than any percentage change in its input current received at connection 51. Thus, this form of the IA1 current amplifier exhibits current regulation properties of its own.

Figure 11:
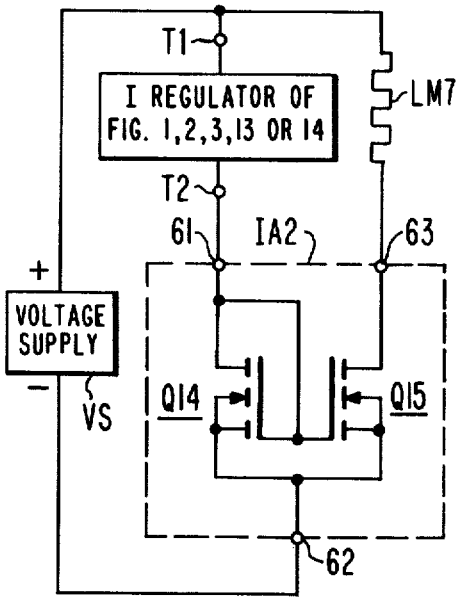

FIG. 11 shows how the output current from the current regulator of FIG. 1, 2, or 3 (or any other current) can be scaled downward in value using a current amplifier IA2 comprising a diode-connected relatively depletion-mode n-channel FET Q14, provided with drain-to-gate feedback for use as a current-to-voltage converter, and a relatively enhancement-mode FET Q15, used as an ensuing voltage-to-current converter. The current regulator is connected between the positive pole of voltage supply VS and the input connection 61 of current amplifier IA2, and the common connection 62 of IA2 is connected to the negative pole of VS. The drain-to-gate feedback connection of Q14 adjusts its source-to-gate voltage $V_{GS14}$ to condition its channel to conduct the current applied between connections 61 and 62. $V_{GS14}$ is applied at the source-to-gate voltage $V_{GS15}$ of Q15 to be converted into a drain current demand presented at output connection 63 of current amplifier IA2. Load means LM 7 is connected between output connection 63 of IA2 and the positive pole of voltage supply VS for conducting current to meet this demand. Thus current demand is smaller than the input current supplied to connection 61, presuming Q14 and Q15 to have channels of similar areas induced under their respective gate electrodes, owing to their being relatively depletion-mode and relatively enhancement-mode.

The invention has thus far been described primarily in a context best befitting linear CMOS (complementary metal-oxide-semiconductor) integrated circuit technology, but is also applicable to BiMOS technology, a mixed technology combining bipolar and MOS field-effect transistor structures. The invention is particularly advantageous in developing a temperature-independent offset voltage somewhat larger than the offset voltage across a forward-biased semiconductor junction when the difference between B+ and B− positive and negative operating potentials is small.

Figure 12:
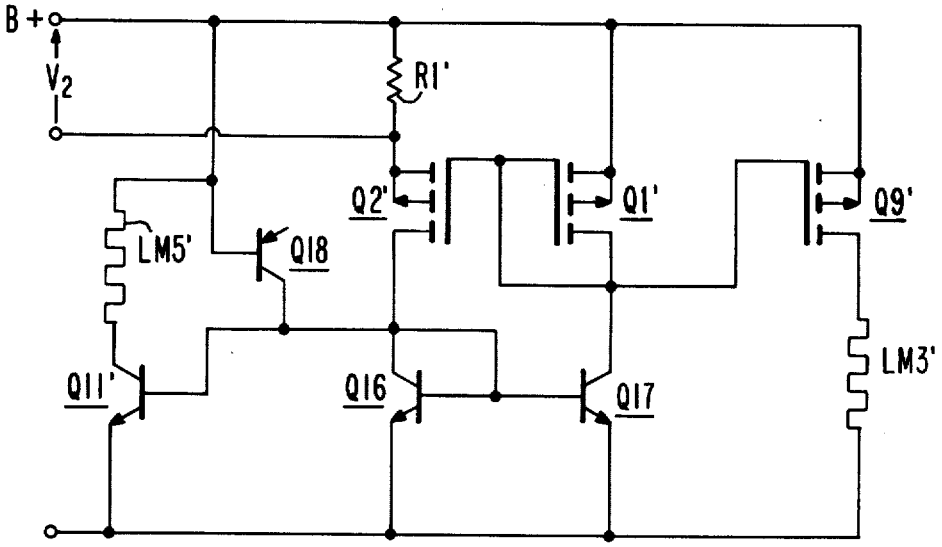
FIG. 12 is a schematic or BiMOS regulator circuitry embodying the present invention.

FIG. 12 shows how such an offset potential $V_2$, may be developed. R1' and p-channel FET's Q1', Q2' operate analogously to R1 and n-channel FET's Q1, Q2 of FIG. 1; and the current mirror amplifier connection of NPN transistors Q16 and Q17 is analogous to CMA 1. The reverse-biased collector-base junction of PNP transistor Q18 which has an uncommitted emitter (and indeed may be a simplified structure with emitter region omitted), supplies leakage current for starting the current regulator. The network as thus far described may be used to bias a p-channel FET Q9' for supplying drain current to load means LM 3', as shown, or to bias an NPN transistor Q11' for demanding collector current from load means LM 5'.

Figure 13:
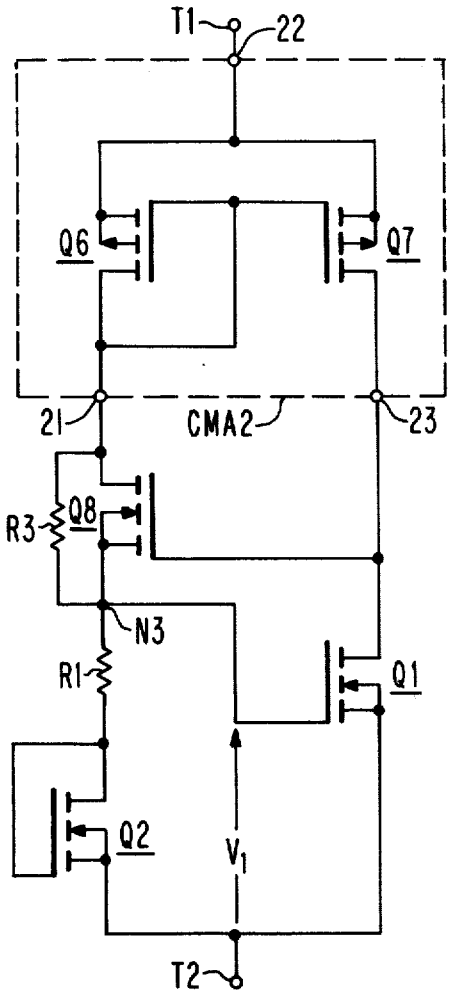
Figure 14:
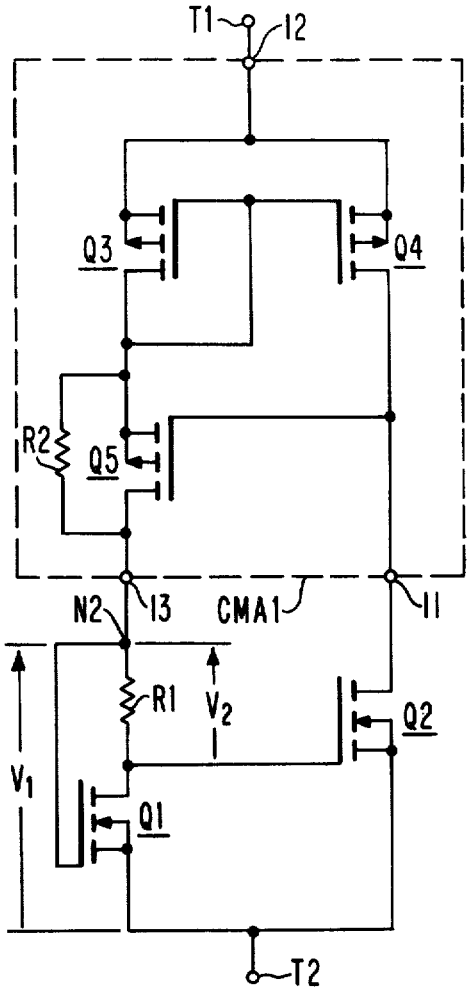

One skilled in the art and armed with the foregoing disclosure will be enabled to readily generate other embodiments of the invention, and this should be considered when construing the following claims. E.g., in the FIG. 2 current regulator Q2 with source-to-gate feedback provided by direct connection is a diode structure in series connection with R1; and these elements may be rearranged in their series connection as shown in FIG. 13. As a further example, the FIG. 1 current regulator may be modified as shown in FIG. 14 connecting the source of Q2 directly to terminal T2 and relocating R1 to place it in the drain current of Q1 to develop the $V_2$ voltage difference between $V_{GS1}$ and $V_{GS2}$. Either of the current regulators shown in FIGS. 13 and 14 can be connected as biasing networks to apply $V_{GS2}$ as the source-to-gate potential of a depletion-mode FET for conditioning its source-to-drain channel to function as a constant current generator.

What is claimed is:

1. Current regulating circuitry comprising:

first and second field-effect transistors of the same conductivity type, the first relatively enhancement-mode and the second relatively depletion-mode, each having respective source, drain and gate electrodes;

a resistive element connected between the source electrodes of said first and second transistors;

an interconnection between the gate electrodes of said first and second transistors; and means, responsive to the difference between the drain currents of said first and second transistors, for generating a voltage applied between the source electrode of said first transistor and the interconnection between the gate electrodes of said first and second transistors, thereby completing a degenerative drain-to-drain feedback connection for said first transistor and a regenerative drain-to-drain feedback connection for said second transistor, co-operating to regulate the drain and source current of each of said first and second transistors.

2. Current regulating circuitry as set forth in claim 1 wherein said means responsive to the difference between the drain currents of said first and second transistors for generating a voltage comprises:

a current mirror amplifier having an input connection to which the drain electrode of said second transistor connects and having an output connection which connects to a node to which the drain electrode of said first transistor also connects; and means for applying the voltage at said node to the interconnection between the gate electrodes of said first and second transistors.

3. Current regulating circuitry as set forth in claim 1 wherein said means responsive to the difference between the drain currents of said first and second transistors for generating a voltage comprises:

a third transistor being of the same conductivity type as said first and second transistors, having an input electrode to which the drain electrode of said first transistor is connected, having an output electrode, having a common electrode connected to a node to which the drain electrode of said second transistor is connected, and having its principal current conduction path between its output and common electrodes, the conductivity of that path being controlled responsive to the voltage between the common and input electrodes;

a current mirror amplifier having an input connection to which the output electrode of said third transistor connects and having an output connection which connects to the input electrode of said third transistor; and means for supplying the voltage at said node to the interconnection between the gate electrodes of said first and second transistors.

4. Current regulating circuitry as set forth in claim 2 or 3 wherein said current mirror amplifier has a further output connection through which a regulated output current flows.

5. Current regulating circuitry as set forth in claim 2 or 3 wherein said current mirror amplifier has a common connection through which a regulated output current flows to load means.

6. Current regulating circuitry as set forth in claim 1 wherein said means responsive to the difference between the drain currents of said first and second transistors for generating a voltage comprises:

a differential-input amplifier with a non-inverting input connection to which the drain electrode of said first transistor connects, with an inverting input connection to which the drain electrode of said second transistor connects, and with an output connection connected to the interconnection of the gate electrodes of said first and second transistors;

a second resistive element connected between the non-inverting input connection of said differential-input amplifier and a terminal for connection to an operating potential; and a third resistive element connected between the inverting input connection of said differential-input amplifier and said terminal for connection to an operating potential.

7. Current regulating circuitry as set forth in claim 6 wherein said terminal for connection to an operating potential is used for supplying regulated output current to load means.

8. Current regulating circuitry as set forth in claim 1, 2, 3, or 6, connected to supply a regulated output current to a load connected at the source electrode of said first transistor.

9. Current regulating circuitry as set forth in claim 1, 2, 3, or 6, including:

a further resistive element having a first end connected to the source electrode of said first transistor and having a second end; and a further field effect transistor, like the second transistor relatively depletion-mode, having a gate electrode connected to the interconnection between the gate electrodes of said first and second transistors, having a source electrode connected to the second end of said further resistive element, and having a drain electrode through which a regulated output current flows.

10. Current regulating circuitry as set forth in claim 1, 2, 3, or 6, including:

a further field-effect transistor, like the first transistor relatively enhancement-mode, having a gate electrode connected to the interconnection between the gate electrodes of said first and second transistors, having a source electrode connected to the source electrode of the first transistor, and having a drain electrode through which a regulated output current flows.

11. A current regulating circuit in series combination with a first resistive element, which series combination receives an operating voltage thereacross and which current regulating circuit comprises:

first and second terminals for connection of said current regulating circuit in said series combination with said first resistive element;

first and second field effect transistors of the same conductivity type and respectively relatively enhancement-mode and relatively depletion-mode, each having a gate electrode and having respective source and drain electrodes with a conduction channel therebetween having a width dimension (W) and a length dimension (L), the conduction of its channel for given source-to-gate voltage depending upon the ratio W/L;

a current mirror amplifier having an input connection from the drain electrode of said second transistor, having an output connection to a node to which the drain electrode of said first transistor connects, and having a common connection to said first terminal;

means for applying potential at said node to an interconnection between the gate electrodes of said first and second transistors;

a connection of the source electrode of said first transistor to said second terminal; and a second resistive element having a resistance proportional to said first resistive element and being connected between said second terminal and the source electrode of said second transistor.

12. A combination as set forth in claim 11 wherein said first resistive element has one end thereof connected to said first terminal, the voltage drop thereacross owing to the flow of regulated current therethrough being applied to further circuitry as at least a portion of a reference voltage.

13. A combination as set forth in claim 11, wherein said first resistive element has one end thereof connected to said second terminal, the voltage drop thereacross owing to the flow of regulated current the therethrough being applied to further circuitry as at least a portion of a reference voltage.

14. A combination as set forth in claim 12 or 13, wherein said first and second field effect transistors are operated at substantially the same temperatures; and wherein the current gain of said current amplifier as between the input and output connections is substantially equal to the W/L ratio of said first transistor divided by the W/L ratio of said second transistor, for making said reference voltage substantially temperature-independent.

15. A current regulating circuit in series combination with a first resistive element, which series combination receives an operating voltage thereacross and which current regulating circuit comprises:

first and second terminals for connection of said current regulating circuit in said series combination with said first resistive element;

first and second field effect transistors of the same conductivity type and respectively relatively enhancement-mode and relatively depletion-mode, each having a gate electrode and having respective source and drain electrodes with a conduction channel therebetween having a width dimension (W) and a length dimension (L), the conduction of its channel for given source-to-gate voltage depending upon the ratio W/L;

a third transistor being of the same conductivity type as said first and second transistors, having an input electrode connected to a first node to which the drain electrode of said first transistor is connected, having an output electrode, and having a common electrode connected to a second node to which the drain electrode of said second transistor is connected, and having its principal current conduction path between its output and common electrodes, the conductivity of that path being controlled responsive to the voltage between the common and input electrodes;

a current mirror amplifier having an input connection to which the output electrode of said third transistor connects, having an output connection which connects to said first node, and having a common connection to said first terminal;

means for applying potential at said second node to an interconnection between the gate electrodes of said first and second transistors;

a connection of the source electrode of said first transistor to said second terminal; and a second resistive element having a resistance proportional to said first resistive element and being connected between said second terminal and the source electrode of said second transistor.

16. A combination as set forth in claim 15 wherein said first resistive element has one end thereof connected to said first terminal, the voltage drop thereacross owing to the flow of regulated current therethrough being applied to further circuitry as at least a portion of a reference voltage.

17. A combination as set forth in claim 15, wherein said first resistive element has one end thereof connected to said second terminal, the voltage drop thereacross owing to the flow of regulated current therethrough being applied to further circuitry as at least a portion of a reference voltage.

18. A combination as set forth in claim 16 or 17 wherein said first and second field effect transistors are operated at substantially the same temperatures; and wherein the current gain of said current mirror amplifier as between its input and output connections is substantially equal to the W/L ratio of said second transistor divided by the W/L ratio of said first transistor, for making said reference voltage substantially temperature-independent.

19. A current regulating circuit in series combination with a first resistive element, which series combination receives an operating voltage thereacross and which current regulating circuit comprises:

first and second terminals for connection of said current regulating circuit in said series combination with said first resistive element;

first and second field effect transistors of the same conductivity type and respectively relatively enhancement-mode and relatively depletion-mode, each having a gate electrode and having respective source and drain electrodes with a conduction channel therebetween having a width dimension (W) and a length dimension (L), the conduction of its channel for given source-to-gate voltage depending upon the ratio W/L;

a differential input amplifier having a non-inverting input connection to which the drain electrode of said first transistor connects, having an inverting input connection to which the drain electrode of said second transistor connects, and having an output connection connected to an interconnection between the gate electrodes of said first and second transistors;

first and second resistive means connecting said first terminal to the non-inverting input terminal of said differential-input amplifier and to its inverting input terminal, respectively;

a connection of the source electrode of said first transistor to said second terminal; and a second resistive element having a resistance proportional to said first resistive element and being connected between said second terminal and the source electrode of said second transistor.

20. A combination as set forth in claim 19, wherein said first resistive element has one end thereof connected to said first terminal, the voltage drop thereacross owing to the flow of regulated current therethrough being applied to further circuitry as at least a portion of a reference voltage.

21. A combination as set forth in claim 19, wherein said first resistive element has one end thereof connected to said second terminal, the voltage drop thereacross owing to the flow of regulated current there therethrough being applied to further circuitry as at least a portion of a reference voltage.

22. A combination as set forth in claim 20 or 21, wherein said first and second resistive elements have respective resistances, the ratio of the resistance of the first to that of the second being substantially equal to the W/L ratio of said second transistor divided by the W/L ratio of said first transistor.

23. A source of regulated current comprising:

first and second field effect transistors of the same conductivity type, the first relatively enhancement-mode and the second relatively depletion-mode, each having respective source, drain and gate electrodes;

a resistive element connected between the source electrodes of said first and second transistors;

an interconnection between the gate electrodes of said first and second transistors;

means for applying a current between the source and drain electrodes of said first transistor;

means direct coupling the drain electrode of said first transistor to the interconnection between the gate electrodes of said first and second transistors for adjusting the gate potential of said first transistor to condition it to conduct as drain current the current applied to its drain electrode and for adjusting the gate potential of the second transistor to condition it to conduct as drain current said regulated current.

24. A source of regulated current comprising:

first and second field effect transistors of the same conductivity type, the first relatively depletion-mode and the second relatively enhancement-mode, each having respective source, drain and gate electrodes;

an interconnection between the source electrodes of said first and second transistors;

an interconnection between the gate electrodes of said first and second transistors;

means for applying a current between the source and drain electrodes of said first transistor; and means direct coupling the drain electrode of said first transistor to the interconnection between the gate electrodes of said first and second transistors for adjusting the gate potential of said first transistor to condition it to conduct as drain current the current applied to its drain electrode and for adjusting the gate potential of the second transistor to condition it to conduct as drain current said regulated current.

25. In combination:

first and second terminals for receiving an operating voltage therebetween;

first and second field-effect transistors of the same conductivity type, the first relatively enhancement-mode and the second relatively depletion-mode, each having respective source, drain, and gate electrodes, their source electrodes being connected without substantial intervening impedance to said first terminal;

an interconnection between the gate electrodes of said first and second transistors;

means for supplying a current connected between said second terminal and the drain electrode of said first transistor;

means direct coupling the drain electrode of said first transistor to the interconnection between the gate electrodes of said first and second transistors for adjusting the gate potential of said first transistor to condition it to conduct as drain current the current applied to its drain electrode and for adjusting the gate potential of the second transistor to condition it to conduct and output current as its drain current; and load means for utilizing said output current connected between the drain electrode of said second transistor and said second terminal.

26. Current regulating circuitry comprising:

first and second terminals for receiving an operating potential therebetween;

first and second field-effect transistors of the same conductivity type, the first relatively enhancement-mode and the second relatively depletion-mode, each having a source electrode connected at said second terminal and having respective drain and gate electrodes;

a first resistive element having a first end connected to the gate electrode of said first transistor and having a second end connected to the gate electrode of said second transistor, to which second end the drain electrode of said second transistor connects;

a third transistor of a conductivity type similar to that of said first and second transistors, having an input electrode to which the drain electrode of said first transistor connects, having an output electrode, having a common electrode connected to the first end of said first resistive element, and having its principal current conduction path between its output and common electrodes, the conductivity of that path being controlled responsive to the voltage between the common and input electrodes; and a current mirror amplifier having an input connection to which the output electrode of said third transistor connects, having an output connection which connects to the input electrode of said third transistor, and having a common connection connected to said first terminal, whereby the flow of current between said first and second terminals is regulated.

27. Current regulating circuitry comprising:

first and second terminals for receiving an operating potential therebetween;

first and second field-effect transistors of the same conductivity type, the first relatively enhancement-mode and the second relatively depletion-mode, each having a source electrode connected at said second terminal and having respective drain and gate electrodes;

a first resistive element having a first end connected to the gate electrode of said first transistor and having a second end connected to the gate electrode of said second transistor, to which second end the drain electrode of said first transistor connects; and a current mirror amplifier having an input connection to which the drain electrode of said second transistor connects, having an output connection which connects to the first end of said first resistive element, and having a common connection connected to said first terminal, whereby the flow of current between said first and second terminals is regulated.

28. Current regulating circuitry as set forth in claim 26 or 27, wherein said current mirror amplifier has a further output connection through which a regulated output current flows.

29. Current regulating circuitry as set forth in claim 26 or 27, including a further field-effect transistor of the same conductivity type as said first and second transistors having a gate electrode connected to that of one of said first and second transistors, having a source electrode connected to said second terminal, and having a drain electrode through which a regulated output current flows.

30. Current regulating circuitry as set forth in claim 26 or 27 in series connection with a second resistive element across a supply of operating potential, said second resistive element having a resistance proportional to that of said first resistive element, and means for utilizing the voltage drop across said second resistive element.

* * * * *